United States Patent [19]

Maron

[11] Patent Number: 4,821,563

[45] Date of Patent: Apr. 18, 1989

[54] APPARATUS FOR MEASURING WEIGHT, TORQUE AND SIDE FORCE ON A DRILL BIT

[75] Inventor: Robert Maron, Cromwell, Conn.

[73] Assignee: Teleco Oilfield Services Inc., Meriden, Conn.

[21] Appl. No.: 144,471

[22] Filed: Jan. 15, 1988

[51] Int. Cl.[4] ..... E21B 47/00

[52] U.S. Cl. ..... 73/151; 175/40

[58] Field of Search ..... 73/151, 151.5, 862.19, 73/862.54, 862.65; 175/40

[56] References Cited

U.S. PATENT DOCUMENTS 4,359,898 11/1982 Tanguy et al. ..... 73/151

4,715,451 12/1987 Bseisu et al. ..... 73/151 X

*Primary Examiner*—Jerry W. Myracle

*Attorney, Agent, or Firm*—Fishman, Dionne & Cantor

[57] ABSTRACT

Apparatus is presented for measuring weight, torque and side force (bending) on a drill bit for oil and gas well drilling. Strain gages are located in radial holes in the wall of a drill collar sub for measuring each of the three parameters of weight, torque and bending. The holes are sealed by inner and outer plugs and a ring and bolt structure retains the plugs in place. For torque and bending measurements, the strain gages are arranged with symmetry of position beteween diametrically opposed holes. The strain gages are positioned in a novel array which departs from symmetry of position to minimized errors in the weight measurement caused by pressure changes in the drilling fluid.

24 Claims, 4 Drawing Sheets

APPARATUS FOR MEASURING WEIGHT, TORQUE AND SIDE FORCE ON A DRILL BIT

BACKGROUND OF THE INVENTION

This invention relates to the field of borehole measurements. More particularly, this invention relates to new and improved apparatus for measuring weight, torque and side forces on a drill bit.

It is well known that the parameters of weight-on-bit (WOB), torque-on-bit (TOB) and side or bending force on bit (BOB) are important values to measure and/or control in the drilling of a well such as an oil or gas well. Measurement and control of WOB are important in regard to rate of penetration, rate of bit wear, and direction of drilling. WOB information can also be used to analyze drilling rate data to obtain information relating to formation porosity. Measurement and control of TOB are important in regard to drill bit wear; and measurement and control of BOB are important in regard to controlling the direction in which the borehole deviates from a straight path.

In the past it has been common to make WOB and TOB measurements at the surface. WOB has been measured at the surface by comparing off-bottom and drilling hookload weights. TOB has been measured by monitoring current supply to the rotary table drive motor or mechanical force on part of the rotary drive mechanism. However, such surface measurements are not highly reliable. Beyond that, it is not even possible to measure BOB at the surface. In the more recent past, particularly with the advent of reliable Measurement While Drilling (MWD) systems and telemetry systems for transmitting downhole measurements to the surface, proposals have been made to measure WOB and TOB downhole.

One of the more interesting of those recent proposals is disclosed in U.S. Pat. No. 4,359,898 in which strain gages are located in radial holes in a drill string segment. While the general concept of locating strain gages in radial holes is of interest and is used in the present invention, the system of that prior patent has complicated features that are eliminated in the present invention. For example, that prior patent requires a pressurized axial sleeve extending above and below the radial holes to eliminate stress concentrations in the drill string body in the vicinity of the openings resulting from pressure differentials of well fluids; and it also requires a sealed tube extending across the bore of the drill string which supports end plugs and, in conjunction with the end plugs establishes an atmospheric chamber in which the strain gages are located. Those features, while necessary for proper operation of the system of that prior patent, add significant complication and expense to the system.

SUMMARY OF THE PRESENT INVENTION

The apparatus of the present invention achieves a reliable system for downhole measurement of WOB, TOB and BOB while eliminating or reducing many of the drawbacks or complexities of the prior art.

The apparatus of the present invention is located in a short tubular member (a drill collar "sub") connected to the bottom of an MWD tool, which is then located as closely as possible above the drill bit. Sensing elements consisting of foil type electrical resistance strain gages are mounted on the peripheral walls of radially oriented cylindrical holes in the sub wall to sense the load-induced strains in the material. The gages for each type of measurement are connected in a bridge configuration and are positioned so that the bridge is sensitive essentially only to the type of loading that is being measured, and is insensitive to the other two types of loading (i.e., the WOB measurement is essentially not affected by torque or bending, TOB measurement is essentially not affected by weight or bending and BOB measurement is essentially not affected by weight or torque). To minimize errors in all measurements due to temperature gradients across the sub wall, all strain gages are mounted at approximately the mid-wall radius, where no thermal strains exist during steady state temperature conditions. There are four strain gages for each parameter to be measured. For each parameter there are two strain gages in each of two diametrically opposed holes. The strain gages for measuring TOB and BOB are arranged with symmetry of position. To minimize errors in the WOB measurement due to pressure differentials across the sub wall, the strain gages in the WOB bridge are mounted is a precise and novel array so that the WOB bridge output is insensitive to strains caused by pressure differentials across the sub wall. The location of the WOB strain gages departs from symmetry of position. The holes in which the strain gages are mounted are isolated from well fluids by a system of sealed inner and outer plugs. A plug support ring in the centerbore of the sub interacts with the plugs to form a force balance system.

An instrument package, which is located in the bore of the sub, is connected mechanically and electrically to the MWD tool located above it. The instrument package is also connected mechanically to the wall of the sub by a flexible member, which provides a sealed conduit for electrical wires. These wires electrically connect the instrument package to a small circuit board located in a sealed hole in the wall of the sub. The circuit board is also electrically connected to the strain gages located in the two holes closer to the drill bit. These connections are accomplished by means of wires that pass through long sealed passages drilled in the wall of the sub. The circuit board amplifies the strain gage bridge output signals for delivery to the instrument package. This scheme results in all strain gages, electrical circuit boards, wiring, and interconnections being located in sealed, dry holes at one atmosphere of pressure, which contributes significantly to system reliability.

The arrangement of the strain gages, the bridges and the force balance system of the plugs and plug support ring, combine to produce a novel and improved system and apparatus for measuring WOB, TOB and BOB which is both reliable and eliminates many of the complexities of the prior art.

The above discussed and other advantages of the present invention will be apparent to and understood by those skilled in the art from the following detailed description and drawings.

BRIEF DESCRIPTION OF THE DRAWINGS

Referring now to the drawings wherein like elements are numbered alike in the several Figures.

DESCRIPTION OF THE PREFERRED EMBODIMENT

Figure 1:
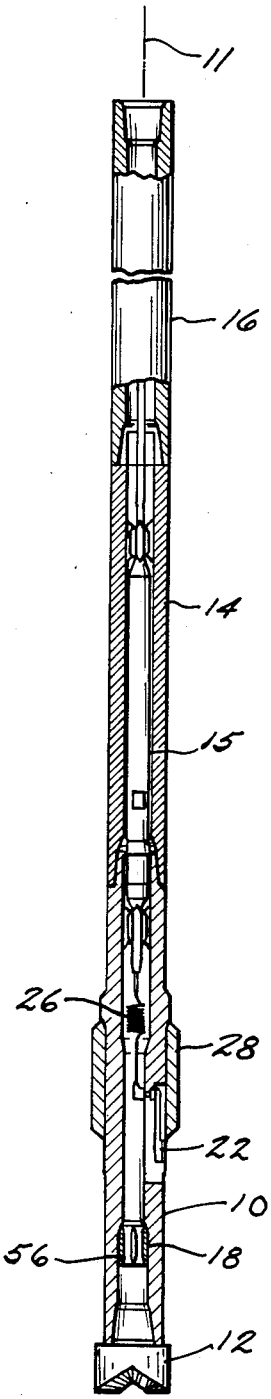
FIG. 1 is a general or schematic showing of drillstring subs at or near the bottom of a drillstring.
Figure 2:
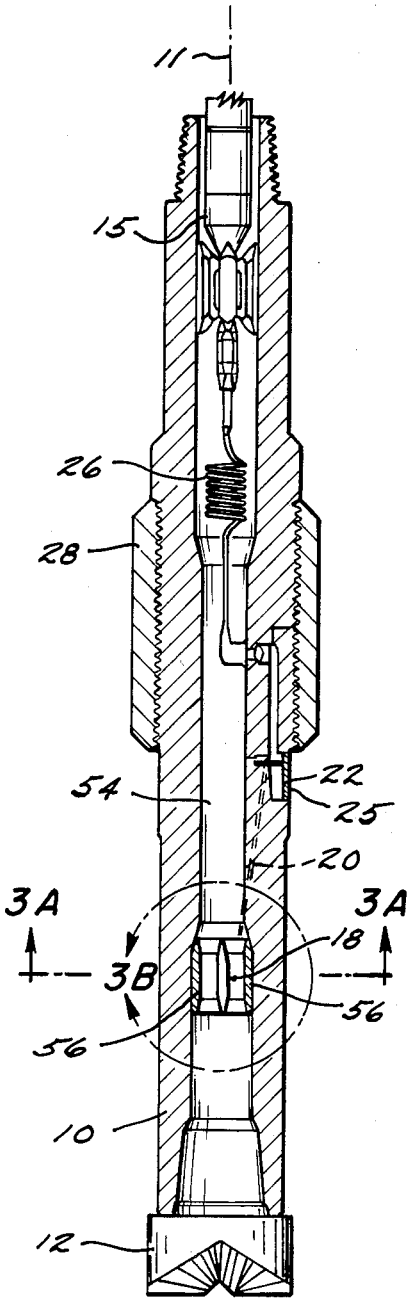
FIG. 2 is a more detailed showing of the drillstring sub of FIG. 1 which contains the apparatus of the present invention.

Referring first to FIGS. 1 and 2, the general environment is shown in which the apparatus of the present invention is located. The apparatus of the present invention is contained in a short (about 5–6 feet long) measuring sub 10. Preferably, sub 10 is made of beryllium copper rather than stainless steel which is typical for downhole subs because Young's Modulus for beryllium copper is about 40% lower than steel and the strains are about 40% higher for a given load. This leads to more sensitive measurements. Also, since beryllium copper has a high coefficient of thermal conductivity, temperature transients, which can cause errors in measurements, diminish more quickly than in a stainless steel sub. A drill bit 12 is preferably connected immediately below measuring sub 10 so that the measurement point for WOB, TOB, and BOB is immediately above the drill bit. The top of the measuring sub is connected to an intermediate sub 14 which may house other MWD sensors, such as directional sensors, and an instrument package 15 including electronics for use with the strain gage sensors of the present invention and other such sensors. Intermediate sub 14 is connected at its top to an MWD transmitter sub 16 which may house, e.g., a mud pulse transmitter for transmitting downhole measurements, including WOB, TOB and BOB measurements obtained with the present invention, to the surface without the need for electrical cables.

The strain gages of the present invention are mounted in radial through-holes at the axial position indicated at 18 (but not shown in detail in FIGS. 1 and 2). Those strain gages are connected by wires in long inclined drilled holes 20 in the wall of the sub to a circuit board 22 housed in a recess 24 in the outer wall of the sub. That circuit board is, in turn, connected by a flexible connector 26 to the instrument package 15 in sub 16. If desired, a near-bit stabilizer 28 may be mounted on sub 10. Recess 24 is closed or covered by a cover 25 (see FIG. 3) bolted or otherwise fastened to the sub.

Figure 3B:
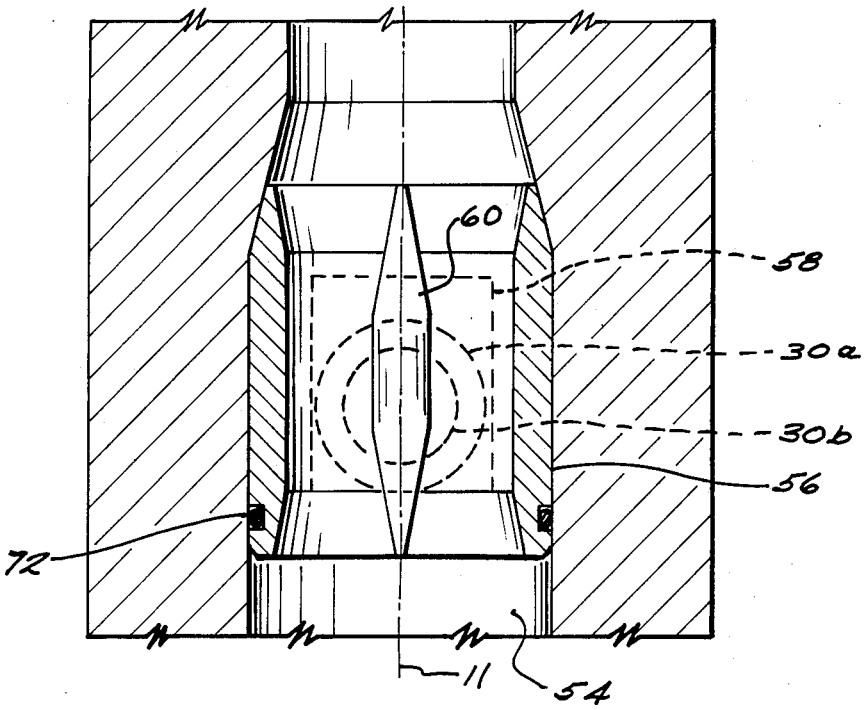
FIG. 3B is a sectional view along line B—B of FIG. 2.
Figure 3A:
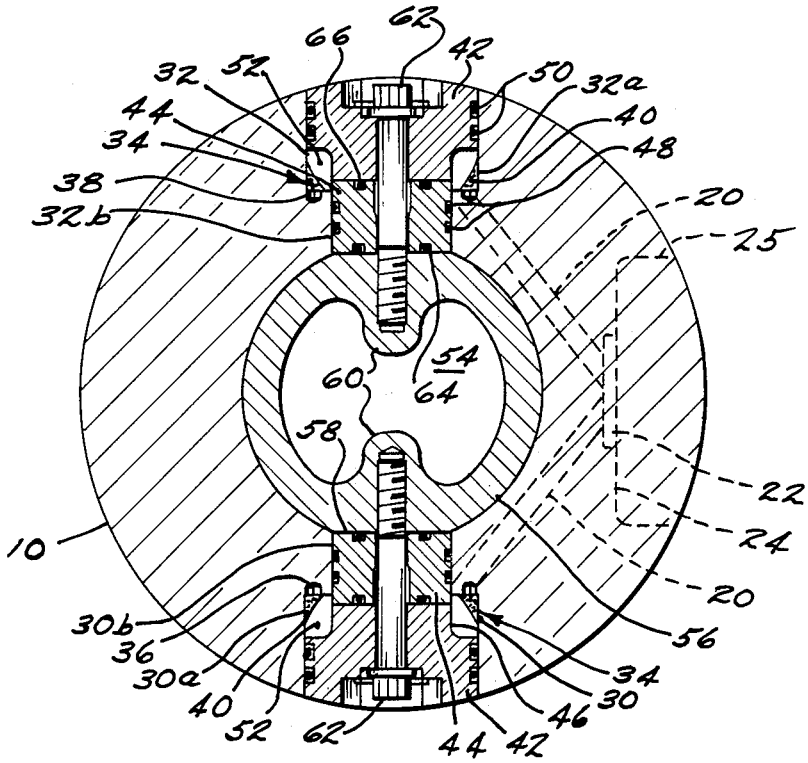
FIG. 3A is a sectional view taken along line A—A of FIG. 2.
Figure 4:
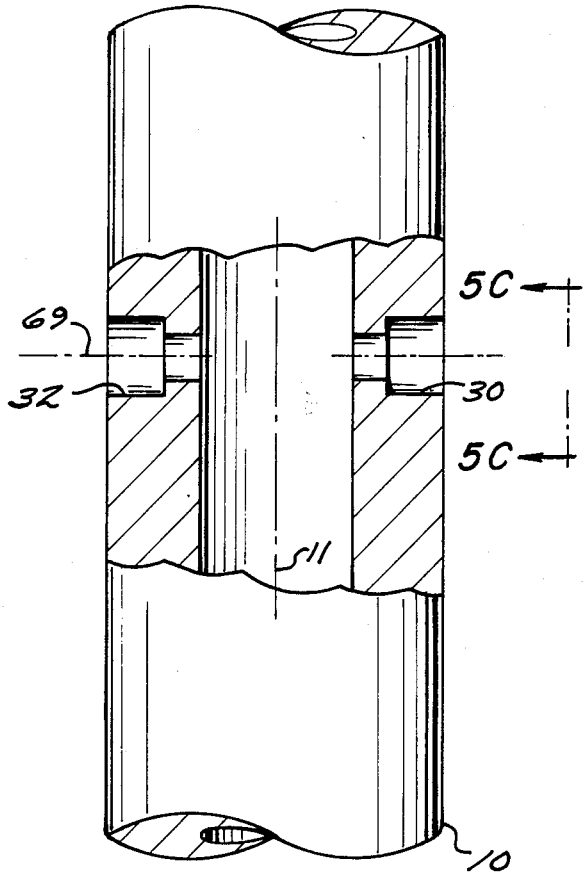
FIG. 4 is a schematic sectional elevation view of the portion of the drillstring sub having the strain gage mounting holes.
Figure 5:
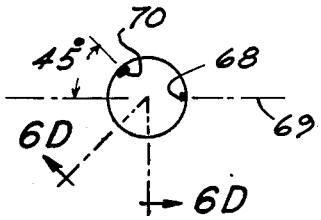
FIG. 5 is a view along line C—C of FIG. 4.
Figure 6:
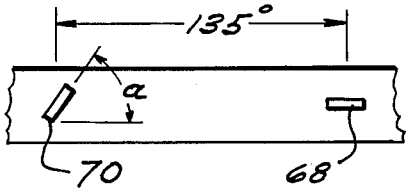
FIG. 6 is a plane projection along line D—D of FIG. 5, the WOB strain gages in relative position in one hole.

Referring now to FIG. 3, sub 14 has a pair of diametrically opposed radially extending circular through-holes 30 and 32. If a stabilizer is used, the holes 30 and 32 are located between the near bit stabilizer and the drill bit to ensure that the WOB, TOB and BOB measurements are made below the stabilizer and as close as possible to the drill bit. This is an important consideration since WOB, TOB and BOB measurements made above a stabilizer would be subject to errors induced by the presence of the stabilizer. Each of the holes has a large diameter outer section 30*a*, 32*a* and a smaller diameter inner section 30*b*, 32*b*. An array of strain gages are mounted on the cylindrical walls of large hole sections 30*a* and 32*a* in the general vicinity indicated at 34. Connecting wires run from the strain gages in annular recesses 36 and 38 at the base of each large diameter section, and those wires then run along the drilled holes to connect to the circuit board 22 in recess 24. The strain gages and wires in recesses 36 and 38 may be covered by a potting compound 40 to secure them in place and protect them from damage.

Each hole has an outer seal plug 42 (with an OD to match the ID of the large hole section) and an inner seal plug 44 (with an O.D. to match the ID of the reduced small hole). Outer plug 42 has a reduced diameter section 46 of diameter equal to the diameter of inner plug 44. The inner and outer plugs meet and butt against each other at flat facing surfaces. Each pair of plugs cooperate to define an annular atmospheric chamber 52 in which the strain gages are located. The plugs are made of the same material as sub 10, i.e., preferably beryllium copper material. "O" ring seals 48 and 50 seal the OD of plugs 42 and 44, respectively, relative to the walls of the hole sections to prevent leakage of external fluids from the borehole annulus (between the exterior of the drillstring and the wall of the borehole) or from the internal bore 54 of the drillstring into chamber 52.

An internal metal ring 56 (again preferably of the same material as sub 10) is located in drillstring centerbore 54, and ring 56 has a cylindrical OD around most of its periphery to form a loose fit with the ID of the center bore of the drillstring sub 14. Ring 56 has opposed flat surfaces 58 against which flat inboard facing surfaces of plug segments 44 meet and butt. Ring 56 also has a pair of inwardly projecting flanges 60 to receive plug fastener bolts 62. The bolts 62 fastens and secure the plug segments in place. An "O" ring 64 at the inboard face between each plug 44 and the flat 58 on ring 56 provides additional sealing against leakage from the centerbore of sub 10 into atmospheric chamber 52 or to the borehole annulus; and an "O" ring seal 66 at the flat abutting surfaces between plug segments 42 and 44 to further seal against leakage from the borehole annulus into atmospheric chamber 52. While the plug structure is preferably in two sections (42, 44) for ease of alignment in assembly, it could be a one piece element, and "O" ring 66 would be eliminated.

It should be noted that while center ring 56 would be adequate by itself to prevent plugs 42 and 44 from being pushed in by high pressure in the borehole annulus (i.e., when the annulus pressure exceeds the pressure in sub centerbore 54), fastener 62 is necessary to prevent the plugs from being blown out when the pressure in sub centerbore 54 exceeds the borehole annulus pressure. This is due to the fact that the exterior of ring 56 is not sealed with respect to the body of sub 14. Thus, the inboard surface of each plug 44 (i.e., the surface in contact with the flat face 58 on ring 56) is exposed to the pressure of fluid in sub centerbore 54; and the plugs would be blown out if they were not retained by fastener 62 mechanically grounded to ring 56.

A sectional elevation view of ring 56 is shown in FIG. 3B. While ring 56 extends slightly above and below the passageways 30, 32, the axial length of ring 56 above and below the passageways and flat 58 is not significant, because the only role of ring 56 is to serve as a fastening point for bolts 62 and to bear the inwardly or outwardly directed forces, if any, on the plugs. An "O" ring seal 72 near the bottom of ring 56 serves to prevent the existence of a free flow path for drilling fluid between ring 56 and the ID of sub 10. Such a free flow path could cause erosion. However, ring 56 is not sealed with respect to sub 10, because it is intended that the inboard surface of plugs 44 see the pressure of the fluid in centerbore 54.

It will be noted that ring 56, plugs 42, 44 and bolts 62 form a pressure balance system. Regardless of whether the pressure in centerbore 54 is higher (the normal state) or lower than the pressure in the borehole annulus, the load across the plugs is equal and opposite and is transmitted to ring 56.

Each of the three measurements (WOB, TOB, BOB) uses an array of four strain gages connected in a bridge configuration. Six strain gages are bonded in precisely determined arrays to the cylindrical walls in the large diameter part of each of the holes in which they are located. In each case (i.e., for measurement of WOB, TOB and BOB), two of the strain gages are mounted in the atmospheric chamber of hole 30 and two strain gages are mounted in the atmospheric chamber of hole 32. The gages sense strain, or elastic deformation in the walls of the holes to which they are bonded. The strains are proportional to the loads applied to the sub. The strains result in changes in the electrical resistance of the strain gages. In the bridge circuit, this produces an output measurement voltage proportional to he strain.

Figure 7:
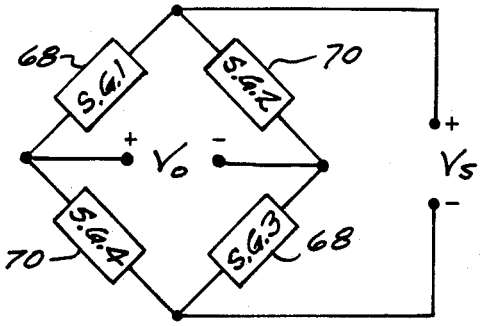
FIG. 7 is a showing, of a bridge circuit with strain gages.

FIGS. 4–6 and 8 show details of the placement of the strain gages for measurement of WOB, and FIG. 7 shows the strain gages connected in a bridge circuit for measurement. WOB strain gages 68 will sometimes be referred to as primary weight gages, and WOB strain gages 70 will sometimes be referred to as secondary weight gages.

The arrangement of the WOB strain gages is an essential feature of the present invention for measurement of WOB. Each primary WOB gage 68 is positioned with its sensitive axis perpendicular to the axis 69 of hole 30 (or 32), i.e., with its sensitive axis extending parallel to the axis 11 of sub 10. (Of course, since the strain gages are mounted on curved wall surfaces, it will be understood that the references to parallel and perpendicular relationships are references to plane projections.) The primary WOB strain gage 68 in each hole is mounted to sense axial strain, i.e., strain parallel to the sub axis. The gages 68 are also located at the same position in opposite holes, so that the primary gages are diametrically opposite each other, thus cancelling effects of bending when properly combined in a bridge. Using a clock convention, each gage 68 is mounted with its center at either 3:00 o'clock or 9:00 o'clock, with the sensitive axis running in the general direction of 12:00 o'clock to 6:00 o'clock. As is well known in the prior art, gages thus properly positioned to measure axial strain on a cylindrical structure are also essentially insensitive to strain due to torsion loading on the structure. Therefore, these two gages 68 only measure axial load on the sub.

The additional two gages in a WOB bridge would, according to prior art, be positioned to measure hoop strain, which occurs 90 degrees to the axial strain, in a direction around the circumference of the sub. For pure axial loading on the sub, this hoop strain is actually what is called the Poisson strain, which is proportionally related to the axial strain. The axial and Poisson strains are commonly referred to as principal strains. The use of gages in a WOB bridge which measure Poisson strain has the advantage of increasing the output signal level of the bridge. However, in the present invention, the use of the hoop gages in such a manner would have a disadvantage because the rather large strains caused by pressure changes are oriented in the hoop direction. This would make the WOB bridge unacceptably sensitive to pressure changes. Existing solutions to this problem can be found in prior art. One scheme would use a pressure transducer to measure the pressure changes, and then use this information to correct WOB output signal. Another method would use a pressure compensation structure that would equalize the pressures on both sides of the sub wall, thus eliminating the hoop strain due to pressure differentials. However, both schemes require hardware and/or software to function, thus increasing the cost and complexity of the device, while decreasing its reliability.

In accordance with the present invention, the problem is solved in a novel manner by positioning the two secondary weight gages 70, in a location and at an orientation where there are no significant strains due to pressure or torsion loading. Considering hole 30, secondary gage 70 is angularly displaced relative to primary gage 68 about the axis 69 of the hole to a position where its sensitive axis makes it insensitive to weight. That means the secondary gage 70 is positioned so that its sensitive axis is at an angle of 45° to the axis 11 of sub 10. That means that secondary gage 70 is centered at a position displaced either ±45° or ±135° relative to primary gage 68, i.e., using the clock convention, at either 1:30, 4:30, 7:30 or 10:30.

Figure 8B:
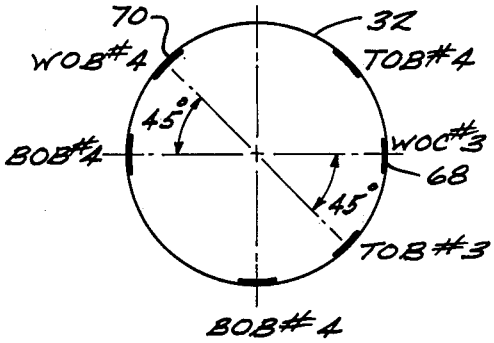
FIGS. 8A and 8B show a preferred orientation of strain gages about the two opposite holes.
Figure 8A:
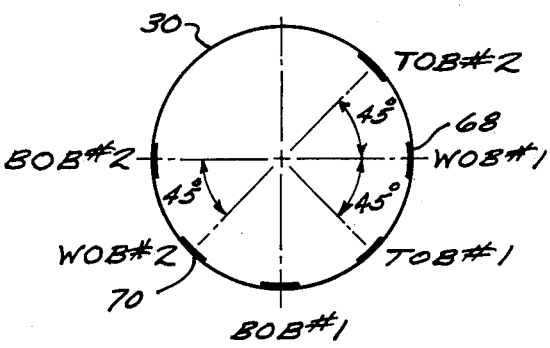

The preceding discussion was directed to the angular displacement of secondary WOB gage 70 relative to primary gage 68 in hole 30. A similar displacement takes place in hole 32, but with an important difference. That difference is that the secondary WOB gage 70 in hole 32 is not displaced to the same quadrant to which the secondary WOB gage is displaced in hole 30; rather, it is displaced to a quadrant which is above or below that for which symmetry of position would exist. That is, it is centered on a line parallel to axis 11 but 90° displaced from the position for which positional symmetry would exist. These relative positions are shown in FIGS. 8A and 8B. In FIG. 8A (for hole 30), WOB primary gage 68 (also marked W1) is centered at 3:00 o'clock and secondary WOB gage 70 (W2) is centered at 7:30. In hole 32 (FIG. 8B), primary WOB gage 68 (W3) is also at 3:00 o'clock (thus being diametrically opposed to and symmetrical with gage W1. However, secondary WOB gage 70 (W4) instead of being positioned at 7:30 to be symmetrical with W2, is positioned at 10:30 (i.e., on a line 11(*a*) parallel to axis 11) but displaced 90° to be in the next quadrant. Placement of WOB secondary gage 70 (W4) anywhere along line 11(*a*) establishes bending symmetry with respect to secondary gage 70 (W2), so all bending loads are cancelled out. However, placing gage W4 at 10:30, as shown in FIG. 8B, also establishes torque symmetry and cancels out torque loads (which would not be the case if gage W4 were positioned at 7:30). The previously discussed ±45° or ±135° displacement of gages 70 relative to gages 68 makes gages 70 insensitive to weight, torque and bending.

In addition to being displaced, gages 70 are also rotated about an axis perpendicular to hole axis 69 by equal and opposite amounts (so that symmetry with respect to the axis of the sub is maintained) to the positions where the effects of pressure differential loads across the sub 10 are also essentially eliminated in the output of the WOB bridge. The amount of this rotation required for secondary gages 70 can be calculated approximately by mathematical methods of stress analysis known in the art. However, in accordance with the present invention, the precise amount of this rotation is determined empirically in each case to refine or optimize the orientation of the secondary gages 70. This is particularly important because the primary gages 68 do have a small output due to pressure differential across the sub which can not be eliminated by positioning of the primary gages. However, that pressure-generated output of the gages 68 is compensated by an equal and opposite output from gages 70 which is achieved by the empirical fine tuning of the rotation position of gages 70. Thus, the effects of pressure, torque and bending loads, which are undesireable and may be viewed as error sources for WOB measurement, are eliminated by the placement of the WOB gages 68, 70 as described herein.

Gages 68 and 70 also are located where they will all be subject to the same temperature, which in this case means the same mid-wall point. That is, the gages 68 and 70 are all centered at equal radial distances from the axis of sub 10. This radial positioning eliminates or minimizes outputs from the bridge due to temperature changes experienced by the gages. This is accomplished because when all four gages are subjected to the same temperature, all gage resistances are equal, since matched sets of gages are used. Subsequently, when all gages experience equal temperature changes, all gage resistances change equally, resulting in no change in the overall bridge output.

To further elaborate on the positioning of secondary gages 70, these gages are positioned on the hole wall so the sensitive axes are oriented 45 degrees to the principal axis of the sub so that there are no significant strains due to pressure loading. It is well known in this field of engineering that principal strains due to pressure loading are oriented parallel to the sub axis, and perpendicular to it. It is also well known that no tensile or compressive strains are present along an axis oriented 45 degrees to the axis of the principal strains. Thus the strain gages 70 are no subjected to pressure induced principal strains. And as previously mentioned, they are also not sensitive to the principal tensile and compressive strains caused by axial loading, since these strains are in the same direction as the principal strains caused by pressure loading.

However, in this location, the gages are still subject to the principal tensile and compressive stains caused by torsion. To eliminate sensitivity to these strains, the principle of Poisson strains is used to determine the rotational orientation of gages 70. For any principal tensile or compressive strain, a corresponding Poisson strain exists along an axis 90 degrees from the axis of the principal strain. This Poisson strain is 0.3 times the magnitude of the principal strain, but most importantly it is opposite in sign. Making use of this fact, each strain gage 70 may be rotated so that its sensitive axis changes from being aligned with the principal strain axis to being aligned with the Poisson strain axis. In so doing, the gage must pass through an angle where there is no strain along its sensitive axis. This is the angle where the strain passes through zero as it changes sign from principal strain to Poisson strain. This is the approximate angle of rotation at which the gages 70 are mounted, subject, however, to fine tuning adjustment to compensate for the pressure induced output of gages 68 as discussed above.

With the gages 68 and 70 in the WOB bridge located in the position discussed above, the WOB bridge is sensitive only to weight on the bit and it is essentially insensitive to principal strains from torsional loading, pressure loading, and bending. This results in the WOB bridge having a slightly lower axial load output signal than if active hoop gages were used, while at the same time being essentially insensitive to the drilling fluid pressure fluctuations normally encountered. The WOB bridge thus measures axial load on the sub, while being insensitive to torsional load, pressure load, and bending.

The location of the strain gages for the TOB measurement is comparatively more straightforward. Two of the four gages in the bridge are located in each of the radially directed holes. The centers of the two TOB gages in each hole are located at the mid points of adjacent quadrants of the hole and are displaced 90° from each other. The sensitive axes of the TOB gages are aligned at 45 degrees from the principal axis of the sub (i.e., the sensitive axes extend along peripheral arcs of the hole 32). Thus, using the same clock convention as above, the TOB gages may be mounted at 1:30 and 4:30 or at 4:30 and 7:30. They would not be mounted with either gage at 10:30 because WOB gage 70 is located there. In each hole, one TOB gage senses the torsionally generated tensile strain, while the other senses the torsionally generated compressive strain that is 90 degrees to the tensile strain. These strains are equal in magnitude but opposite in sign. The gages are combined in the bridge circuit so that their resistance changes all combine to increase the overall bridge output. Based on the principles discussed previously, the TOB bridge is insensitive to axial loading, pressure loading, and bending, while sensing the torque loading as required.

The location of the strain gages for the BOB measurement is also comparatively straightforward. The BOB gages are positioned to measure axial strain and hoop strain. Thus, in each hole one BOB gage is positioned with its sensitive axis parallel to the principal axis of sub 10 and one gage is positioned with its sensitive axis perpendicular to the principal axis of the sub. Using the same clock convention as above, one BOB gage could be at 3:00 o'clock and the other at 6:00 o'clock (with the sensitive axes extending along peripheral arcs of the hole 32). The gages are connected in the bridge circuit in the opposite manner that would be used for measuring axial load. That is, while in the WOB bridge the like gages from opposite holes are in opposite arms of the bridge, for the BOB bridge like gages from opposite holes are in adjacent arms of the BOB bridge. This results in the BOB bridge being sensitive to bending loads, while being insensitive to axial loads. In this arrangement the hoop gages are once again sensitive to pressure fluctuations, but it is not a problem when BOB measurement is made while rotating the sub. The bridge output is then an alternating voltage signal. The individual BOB strain gages see a sinusoidally varying strain due to the reversed bending seen by the sub as it is rotated in the curved borehole. It is the resulting peak-to-peak AC voltage amplitude that is a measure of the bending force magnitude. Therefore any steady-state DC type component, such as generated by a pressure change, would not affect the measurement of bending forces. The direction of the bending side force vector in relation to magnetic north is also determined with this device, again while rotating. For rotation of a drill collar in a curved borehole, the side force vector is essentially fixed in space over short section of the borehole. The phase angle of the BOB bridge output is dependant on the relative position of the side force vector to the position of the strain gage holes. The strain gage holes also have a known angular relationship to a triaxial magnetometer which is located in either sub 15 or 16. Since the magnetometer output is an indication of the angular position of the entire tool with respect to magnetic north, the phase relationship between the magnetometer and the BOB bridge output is an indication of the relationship of the bending side force vector direction to magnetic north. A triaxial accelerometer is also located in sub 15 or 16, and the output of the magnetometer can be compared to the accelerometer output. In this way the direction of the side force can also be related to the top or "high side" of a nonvertical borehole. Thus, both the magnitude, and direction of the bending side force vector can be determined while rotating.

In addition to the previously mentioned strains due to various loadings, there are significant strains created by temperature gradients across the sub wall. These strains are very well understood and documented in prior art. Whenever a temperature difference exists between the outside and inside walls of a cylinder, there are corresponding compressive strains on the higher temperature wall, and tensile strains on the lower temperature wall. Along a radial line moving from one wall to the other, the strains pass through a zero point as they change between tensile and compressive. This is approximately at the mid point of the wall along a radius, and may, for convenience sake, be referred to as the mid-wall point. All strain gages in the device are mounted with their centers at this mid-wall point to eliminate errors due to strains caused by temperature gradient changes. The error is only eliminated when steady-state temperature conditions are reached and all thermal transients have died out, which is why sub 10 is made of beryllium-copper in this invention.

As will be understood by those skilled in the art, the apparatus of the present invention provides an effective and reliable mechanism for downhole measurement of WOB, TOB and BOB, while also eliminating complexities of some prior art devices.

Referring to a joint consideration of FIGS. 7, 8A and 8B, a presently preferred arrangement is shown for positioning all of the strain gages and connecting them in bridge arrays. In FIGS. 8A and 8B, the gages are identified as WOB 1–4, TOB 1–4, and BOB 1–4. In FIG. 7, the gages are numbered S.G.1–S.G.4, with the numbers 1–4 corresponding to the gage numbers 1–4 in FIGS. 8A and 8B. FIG. 7 also shows a specific bridge configuration for the WOB gages 68, 70, but it is to be understood that the bridge arrangement shown in FIG. 7 is generic for TOB and BOB as well, as long as the 1–4 numbering convention is maintained between the strain gages shown in FIGS. 8A and 8B and their connection in the bridge of FIG. 7.

Referring to FIGS. 8A and 8B, the following positioning of the gages occurs in a clock convention taken facing each hole 30:

| | HOLE 30 | | HOLE 32 | |
|---|---|---|---|---|
| | S.G.1 | S.G.2 | S.G.3 | S.G.4 |
| WOB | 3:00(gage 68), | 7:30(gage 70) | 3:00(gage 68), | 10:30(gage 70) |
| TOB | 4:30, | 1:30 | 4:30, | 1:30 |
| BOB | 6:00, | 9:00 | 9:00, | 6:00 |

Thus, it can be seen that the TOB and BOB gages are symmetric in positioning with corresponding gages being diametrically opposed. However, for the WOB gages, while WOB 1 and WOB 3 (the primary gages 68) are symmetrically positioned in diametrically opposed locations, WOB 2 and WOB 4 (the secondary gages 70) are not symmetrically positioned. This positional asymmetry of the secondary gages 70 is actually what enables the present invention to achieve the desired objective of achieving both bending and torque symmetry for the WOB secondary gages to thereby cancel out both bending and torque loads in the WOB measurement, while the previously described rotation of the WOB secondary gages 70 still cancels out pressure differential effects.

FIG. 7 shows a generic bridge arrangement for all sets of gages. Thus, for the WOB gages (also shown numbered in FIG. 7), like gages 1 (68) and 3 (68); 2 (70) and 4 (70) are in opposite arms of the bridge. For TOB, like gages 1 and 3; 2 and 4 are also in opposite sides of the bridge. However, for BOB, like gages 1 and 4; 2 and 3 are in adjacent arms of the bridge. This manner of connecting the various sets of gages in the bridge is required for proper measurements in the present invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for measuring at least one load applied to a drill bit during the drilling of a well, including:

drill string sub means adapted to be connected in a drill string above the drill bit;

hole means for defining a pair of diametrically opposite through-hole means in the wall of said sub;

plug means in each of said hole means, said plug means cooperating with said through hole means to define an atmospheric chamber means in each of said through hole means;

ring means in the centerbore of said drillstring sub;

fastener means for connecting said plug means to said annular ring means;

weight sensor means in each of said through hole means for generating an output in response to at least the parameter of weight on the drill bit; and said weight sensor means including first weight sensor means positioned at a first predetermined position and in a first predetermined orientation in each through hole means to sense the effects of weight; and second weight sensor means in each through hole means positioned at a second predetermined position relative to the first sensor means and in a second orientation relative to the orientation of said first sensor means to cancel the effects of pressure differential across said drill string sub.

2. Measuring apparatus as in claim 1 wherein:

said second predetermined position of each of said second sensor means is selected to establish bending symmetry and cancel the effects of bending loads.

3. Measuring apparatus as in claim 2 wherein:

said second predetermined position of each of said second sensor means is selected to establish torque symmetry and cancel the effects of torque loads.

4. Measuring apparatus as in claim 1 wherein:

the positions of said first weight sensor means in each of said chambers are symmetrical; and the positions of said second weight sensor means in each of said chambers is asymmetrical.

5. Measuring apparatus as in claim 4 wherein:

said torque sensing means includes first and second torque sensing means in each chamber means, said first and second torque sensing means being positioned at first and second predetermined torque sensing positions in each chamber, said first and second predetermined torque sensing positions in one chamber being symmetrical with respect to said first and second predetermined torque sensing positions in the other chamber.

6. Measuring apparatus as in claim 4 wherein:

said bending sensing means includes first and second bending sensing means in each chamber means, said first and second bending sensing means being positioned at first and second predetermining bending sensing positions in each chamber, said first and second predetermined bending sensing positions in one chamber being symmetrical with respect to said first and second predetermined bending sensing positions in the other chamber.

7. Measuring apparatus as in claim 1 including:

torque sensor means in each of said chamber means for generating an output in response to the parameter of torque load on the drill bit.

8. Measuring apparatus as in claim 1 including:

bending sensor means in each of said chamber means for generating an output in response to the parameter of bending load on the drill bit.

9. Apparatus for measuring at least one load applied to a drill bit during the drilling of a well, including:

drill string sub means adapted to be connected in a drill string above the drill bit;

hole means for defining a pair of diametrically opposite through-holes in the wall of said sub;

plug means in each of said through hole means, said plug means being sealed with respect to said sub means and cooperating with said through holes to define an atmospheric chamber in each of said through holes;

ring means in the centerbore of said drillstring sub;

fastener means for connecting said plug means to said ring means;

first and second weight sensor strain gages in each of said chambers for generating electrical outputs in response to loads thereon;

said first weight sensor strain gage in each hole being positioned at a first predetermined position and in a first predetermined orientation to sense the effects of weight;

said second weight sensor strain gage in each chamber being positioned at a second predetermined position angularly displaced relative to the first weight sensor strain gage and with its sensitive axis angularly rotated relative to the sensitive axis of the first weight sensor strain gage to cancel the effects of pressure differential across said drill string sub; and said first and second weight sensor strain gages in each chamber being connected in a bridge circuit with the first weight sensitive strain gages of each chamber being in a first pair of opposed arms of said bridge circuit and the second weight sensitive strain gages of each chamber being in a second pair of opposed arms of said bridge circuit.

10. Measuring apparatus as in claim 9 wherein:

said second predetermined position of each of said second weight sensor strain gages is selected to establish bending symmetry and cancel the effects of bending loads.

11. Measuring apparatus as in claim 10 wherein:

said second predetermined position of each of said second weight sensor strain gages is selected to establish torque symmetry and cancel the effects of torque loads.

12. Measuring apparatus as in claim 9 wherein:

the positions of said first weight sensor strain gage in each of said chambers are symmetrical; and the positions of said second weight sensor strain gage in each of said chambers is asymmetrical.

13. Measuring apparatus as in claim 9 including:

torque sensor strain gages in each of said chambers for generating an output in response to the parameter of torque load on the drill bit.

14. Measuring apparatus as in claim 9 including:

first and second torque sensor strain gages in each chamber, said first and second torque sensor strain gages being positioned at first and second predetermined torque sensing positions in each chamber, said first and second predetermined torque sensing positions in one chamber being symmetrical with respect to said first and second predetermined torque sensing positions in the other chamber.

15. Measuring apparatus as in claim 14 including:

bending sensor strain gages in each of said chambers for generating an output in response to the parameter of bending load on the drill bit.

16. Measuring apparatus as in claim 14 including:

said first and second torque sensor strain gages in each chamber being connected in a bridge circuit with the first torque sensor strain gages of each chamber being in a first pair of opposed arms of said bridge circuit and the second torque sensor strain gages of each chamber being in a second pair of opposed arms of said bridge circuit.

17. Measuring apparatus as in claim 9 including:

first and second bending sensor strain gages in each chamber, said first and second bending sensor strain gages being positioned at first and second predetermined bending sensing positions in each chamber, said first and second predetermined bending sensing positions in one chamber being symmetrical with respect to said first and second predetermined bending sensing positions in the other chamber.

18. Measuring apparatus as in claim 16 including:

said first and second bending sensor strain gages in each chamber being connected in a bridge circuit with the first and second bending sensor strain gages of each chamber being in a first pair of adjacent arms of said bridge circuit and the second bending sensor strain gages of each chamber being in a second pair of adjacent arms of said bridge circuit.

19. Apparatus for measuring at least one load applied to a drill bit during the drilling of a well, including:

drill string sub means adapted to be connected in a drill string above the drill bit;

hole means for defining a pair of diametrically opposite through-hole means in the wall of said sub;

means defining an atmospheric chamber means in each of said through hole means;

weight sensor means in each of said chamber means for generating an output in response to at least the parameter of weight on the drill bit; and said weight sensor means including first weight sensor means positioned at a first predetermined position and in a first predetermined orientation in each chamber means to sense the effects of weight; and second weight sensor means in each chamber means positioned at a second predetermined position relative to the first sensor means and in a second orientation relative to the orientation of said first sensor means to cancel the effects of pressure differential across said drill string sub.

20. Measuring apparatus as in claim 19 wherein:

said second predetermined position of each of said second sensor means is selected to establish bending symmetry and cancel the effects of bending loads.

21. Measuring apparatus as in claim 19 wherein:

said second predetermined position of each of said second sensor means is selected to establish torque symmetry and cancel the effects of torque loads.

22. Measuring apparatus as in claim 19 wherein:

the positions of said first weight sensor means in each of said chambers are symmetrical; and the positions of said second weight sensor means in each of said chambers is asymmetrical.

23. Measuring apparatus as in claim 19 including:

torque sensor means in each of said chamber means for generating an output in response to the parameter of torque load on the drill bit.

24. Measuring apparatus as in claim 19 wherein:

said torque sensing means includes first and second torque sensing means in each chamber means, said first and second torque sensing means being positioned at first and second predetermined torque sensing positions in each chamber, said first and second predetermined torque sensing positions in one chamber being symmetrical with respect to said first and second predetermined torque sensing positions in the other chamber.

* * * * *